US006203080B1

(12) United States Patent
Surplus

(10) Patent No.: US 6,203,080 B1
(45) Date of Patent: Mar. 20, 2001

(54) CAPTURE BAG

(76) Inventor: Donald N. Surplus, 2347 Joanne Cir., Napa, CA (US) 94559

( * ) Notice: Subject to any disclaimer, the term of this patent is extended or adjusted under 35 U.S.C. 154(b) by 0 days.

(21) Appl. No.: 09/347,038

(22) Filed: Jul. 2, 1999

(51) Int. Cl.[7] ..... A01K 29/00; A41D 19/00

(52) U.S. Cl. ..... 294/1.3; 2/159; 294/25; 383/4

(58) Field of Search ..... 294/1.3, 25, 131; 2/16, 20, 158, 159, 161.7; 15/104.8, 227, 257.1; 119/161; 206/223, 496; 383/4, 42, 63, 70, 71, 77, 907

(56) References Cited

U.S. PATENT DOCUMENTS 4,230,354 * 10/1980 Claras ..... 294/1.3
4,252,356 * 2/1981 Tokuzumi ..... 294/1.3
4,902,283 * 2/1990 Rojko et al. ..... 294/1.3 X
5,222,777 * 6/1993 Clonch ..... 294/25 X
5,301,806 * 4/1994 Olson ..... 294/1.3 X
5,704,670 * 1/1998 Surplus ..... 294/1.3 X
5,806,668 * 9/1998 Bixby ..... 294/1.3 X

* cited by examiner

*Primary Examiner*—Johnny D. Cherry
(74) *Attorney, Agent, or Firm*—Malcolm B. Wittenberg

(57) ABSTRACT

A bag is sized to accept a hand, wrist and at least a portion of an arm of the user. The bag has an open end and a closed end and parallel side walls extending from the open end towards the closed end such that the portion of the bag sized to fit over a portion of the user's arm and wrist is in the profile of a square or rectangle. The closed end of the polymeric sheet material is configured to accept the thumb and at least two fingers of a user. The bag is specifically adapted to enable a user to pick up and retain an object whereupon the bag can be everted encasing the object in the polymeric sheet material.

8 Claims, 1 Drawing Sheet

CAPTURE BAG

TECHNICAL FIELD OF THE INVENTION

The present invention is specifically directed toward a bag which can be everted upon the capture of an object creating a container to retain the object for later use or disposal.

PRIOR ART

The present applicant is the inventor of U.S. Pat. No. 5,704,670 directed to a bag used for protecting articles from contamination or for preventing dirty or hazardous articles from contaminating the environment and the user the disclosure of which is incorporated by reference. Plastic bags are used for collecting crime scene evidence, containing food products and disposing waste or hazardous material. If an article is picked up and placed in the bag by hand, the article will be contaminated by the hand, or vice versa. Although gloves can be used, they must be carried and used separately. After they are used to pick up a dirty or hazardous article, they become a source of contamination and present an additional disposal problem. If a delicate article is picked up and placed in a bag with a tool, such as a pair of tongs, the tool may damage the article. The tool may also require cleaning or sterilization. Furthermore, when a wet article is inserted into the bag, it will usually touch the rim of the bag on the way in, so that contamination may be spread by the wet rim even after the bag is tied, so that clean-up may be necessary.

Others have also suggested glove-like products which are capable of being everted and thus capable of retaining objects therein. For example, reference is made to U.S. Pat. No. 4,937,881 dated Jul. 3, 1990. This patent is directed to a garment capable of fitting upon the hand and arm of the user which can be turned inside out and sealed. It is specifically taught that the glove is provided with a widened sleeve extending at least part way up the arm of the user. The outer portion of one side of the sleeve is provided with an adhesive band such that when the glove is removed, the adhesive band is on its inner portion and may be used to seal the glove for container disposal.

U.S. Pat. No. 5,568,955 dated Oct. 29, 1996 is directed to yet another glove-shaped device, in this instance, employed for collection of pet excrement. The device is intended to receive a user's hand and is further provided with an extension for receiving a user's thumb. As was the case with the '881 patent, the invention disclosed in the '955 patent shows a widening of the glove-like device at its open end.

U.S. Pat. No. 4,645,251 dated Feb. 24, 1987 is again directed to a glove-like waste disposal device comprising a relatively thick, heat-insulating flexible inner glove which is placed over the hand of a user. An outer glove is then placed over the inner glove, the outer glove being made of a thin, flexible disposable material. In use, the waste material is picked up by the user whose hand is contained within the inner glove. The outer glove is pealed or stripped off to an inside-out pouch-forming configuration which contains the picked-up waste material therein. The outer glove and the waste material can then be disposed of. It is taught that the inner glove is to be made reusable and serves to insulate the user's hand from the temperature and "feel" of the waste material. It is clearly shown by both the drawing and disclosure of the '251 patent that the glove is intended to be widest at its opening and narrows to conform to the wrist of the user and then widens yet again to accommodate the thumb and fingers of a user's hand.

Applicant's own '670 patent teaches a configuration whereby the glove is intended to have distinct wrist and cuff portions whereby the forward end of the cuff portion is substantially wider than the wrist portion and extends orthogonally from opposite sides of the wrist portion.

Each of the prior art glove-like products, although being capable of capturing and retaining foreign objects, are flawed in their design and execution. Noting that these various products are intended to be of extremely low cost and disposable, the various prior art configurations do nothing but create unnecessary manufacturing complexities which add to the overall per piece cost of the final product.

In addition, oftentimes such products are intended to be employed by a user who desires to insert his fingers, hand, wrist and forearm within the bag rapidly and repeatedly in those instances where repetitive motion is required. As such, any such bag-like device must facilitate the appropriate acceptance of the thumb and fingers of a user without requiring the user to serpentine his hand within the bag as his hand is caused to intricately manipulate through the bag's wrist portion so that proper finger and thumb alignment can be achieved. Instead, devices of this nature should facilitate rapid arm and hand insertion within the bag material for the rapid employment, capture and disposal of appropriate articles.

These and further objects of the present invention will become readily apparent when considering the following disclosure and appended claims.

SUMMARY OF THE INVENTION

The present invention is directed to a bag and a method for employing the bag for grasping an object and capturing the object once the bag has been everted. The bag is sized to accept the hand, wrist and at least a portion of an arm of a user, the bag being characterized as having an open end and a closed end and parallel side walls extending from the open end towards the closed end. As such, the portion of the bag sized to fit over a portion of the user's arm and wrist is in the profile of a square or rectangle. The closed end of the bag is configured to accept a thumb and at least two fingers of the user.

DETAILED DESCRIPTION OF THE INVENTION

Figure 1:
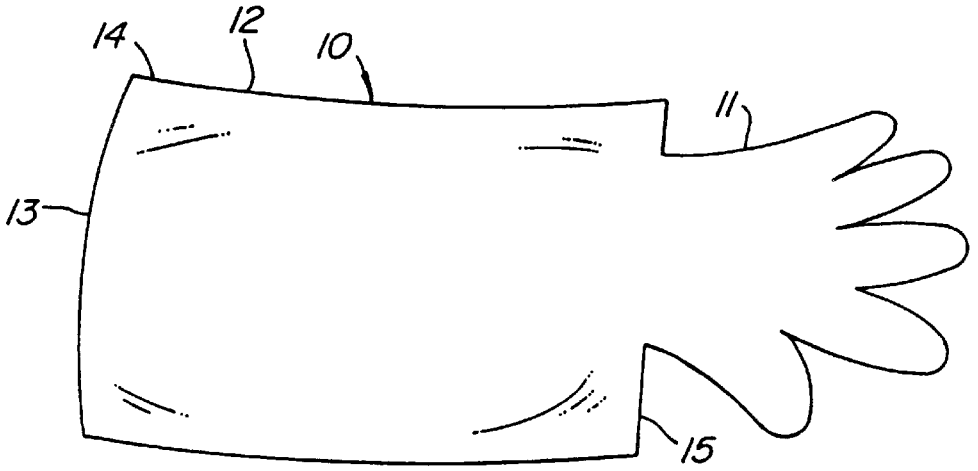
FIG. 1. (PRIOR ART)
FIG. 1 is a plan view of a glove bag produced in accordance with applicant's prior U.S. Pat. No. 5,704,670.

As noted previously, applicant is the inventor of the glove bag disclosed in his U.S. Pat. No. 5,704,670. Specifically, applicant has taught glove bag 10 which includes a glove portion 11 with separate fingers, and enlarged cuff portion 12 with a forward end intricately connected to glove portion 11 and an open end 13. A closure or sealing means 14 is optionally arranged at open end 13. It is noted that the embodiment shown in FIG. 1 includes a forward end of cuff portion 15 extending orthogonally from opposite sides of the wrist portion of the glove bag as shown in the appended figure.

As noted previously, glove bags of this type are intended to be employed by those wishing to rapidly and repetitively insert their hands within the bag whereby the user's thumb and fingers would be naturally guided toward the appropriate thumb and finger or mitt receiving portions of suitable material. However, applicant's embodiment disclosed in his prior '670 patent requires a user to methodically introduce his hand, wrist and arm within the glove bag product to prevent misalignment particularly in the thumb and finger areas.

The bag of this invention can be composed of various materials depending upon its end use. For example, in most applications, polymeric sheet material can be employed such as that now used to make typical plastic bags. Alternatively, the invention can be made of latex, netting, cloth or silicone. The bag can be clear, opaque, textured, perforated, tinted, printed or laminated. Films can be employed that are shrinkable or stretchable as well.

Furthermore, it is recognized that products such as those disclosed and claimed herein are intended to be low cost disposable articles wherein small differences in manufacturing costs can result in the economic acceptance or rejection of this invention in the field. It is particularly noted that a glove bag having parallel side walls and with rounded edges for receiving thumb and finger digits is the most economical design to produce. This product can be manufactured employing a high-speed side weld or side-seal bag machine. Costs can be reduced by as much as 10% over the glove bag of applicant's '670 patent and up to 200–300% over other prior art gloves. As such, it has now been determined that configuring the present invention in a manner disclosed in FIG. 2 will greatly reduce manufacturing costs.

Figure 2:
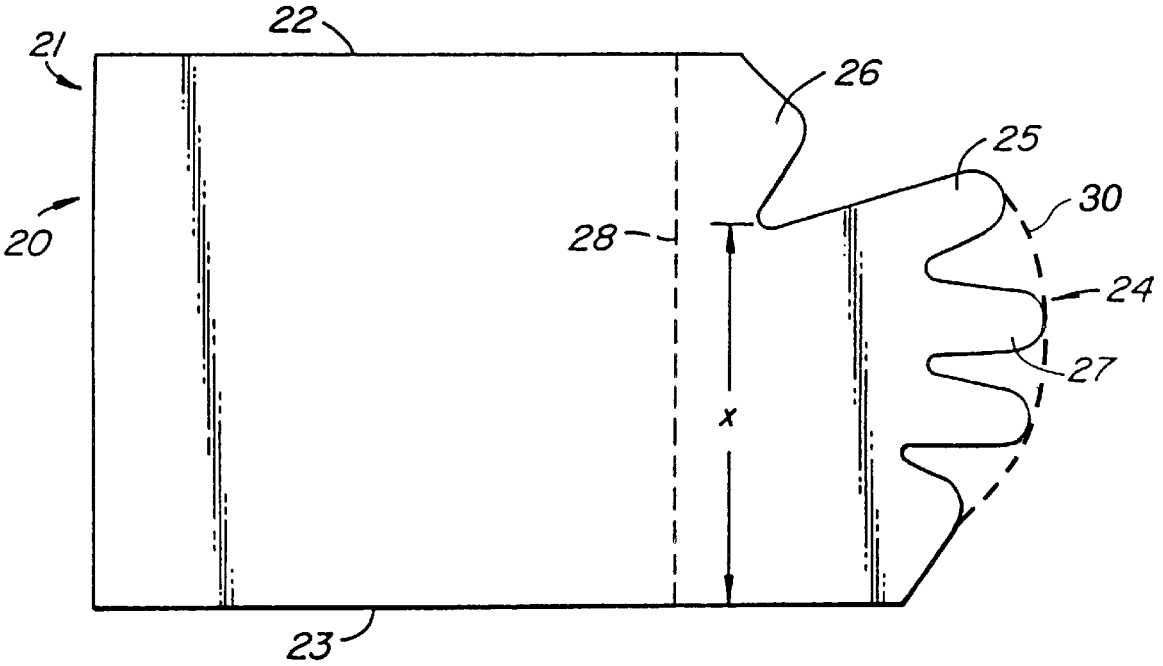
FIG. 2 is a plan view of a bag produced in accordance with the present invention.

As noted by reference to FIG. 2, the present invention comprises a bag 20 of polymeric sheet material sized to accept a hand, wrist and at least a portion of an arm of a user. The bag is characterized as having open end 21, closed end 24 and, unlike the prior art, parallel side walls 22 and 23. As such, the present bag can be characterized such that the portion of the bag sized to fit over a portion of the user's arm as bounded by open end 21, parallel side walls 22 and 23 and phantom line 28 takes on the profile of a rectangle. At closed end 24, the polymeric sheet material is configured to accept a thumb in area 26 and at least two fingers in areas 25 and 27. This rectangular shape optimizes every potential square inch of containment space, unlike any prior art. It is the most efficient design possible relating to minimum material utilization and optimum containment space volume. It minimizes space dedicated to the acceptance of the fingers, eliminates wasted space, maximizes containment space volume, and minimizes raw material utilization therefore minimizing manufacturing cost.

Although the width of knuckle portion X is more narrow than the side walls of the above-described rectangle as defined by open end edge 21 and phantom line 28, the body of the bag, at least in that portion intended to capture the wrist and arm of a user, is provided with parallel side walls 22 and 23 which significantly simplifies and thus reduces the cost of product manufacture. Further, as a user inserts his hand within bag 20 through open end 21, the hand and extended fingers naturally gravitate towards thumb and finger receiving portions 25, 26 and 27. This eliminates the need to serpentine one's hand into devices such as those shown in the prior art and greatly facilitates the rapid and convenient employment of this device. Further, the present invention is intended to include the use of a mitt-like bag wherein instead of separate finger receiving portions 25 and 27, all of a user's fingers are captured by a mitt located at end 24 as shown by dotted line 30.

As in applicant's prior U.S. Pat. No. 5,704,670, the disclosure of which is incorporated by reference, it is intended that the bag, in a preferred embodiment, be provided with a means for closing it once an object has been captured and the bag everted. For example, sufficient material can be provided so that the bag can simply be gathered and tied into a knot. Alternatively, the bag can be provided with sealing means including a zipper of the type sold under the trademark ZIPLOC® by S. C. Johnson Co. Yet a further embodiment could include the use of a foldable flap with an adhesive strip.

Although the above descriptions are specific, they should not be considered as limitations on the scope of the invention, but only as examples. Substitutes and variations are possible within the teachings of the invention and, as such, the invention should only be limited by the scope of the appended claims. For example, other sealing means may be used such as a wire tie, hook and loop fasteners, etc.

I claim:

1. A bag sized to fit over a hand, wrist and at least a portion of an arm of a user, said bag being characterized as having an open end and a closed end and parallel side walls extending from said open end toward said closed end such that the portion of the bag sized to fit over a portion of the user's arm and wrist is in the profile of a single square or single rectangle and, at said closed end, said bag having separate portions for receiving a thumb and at least two fingers of the user when said bag is fit over the hand of a user.

2. The bag of claim 1 further comprising means for selectively sealing its open end.

3. The bag of claim 2 wherein said means for sealing comprises a zip lock strip.

4. The bag of claim 2 wherein said means for sealing comprises an adhesive strip.

5. The bag of claim 1 wherein said portion for accepting at least two fingers of the user comprises a mitt for accepting all fingers of a user.

6. A method of grasping and disposing of an object, said method comprising providing a bag sized to fit over a hand, wrist and at least a portion of an arm of a user, said bag being characterized as having an open end and a closed end and parallel side walls extending from said open end toward said closed end such that the portion of the bag sized to fit over a portion of the user's arm and wrist is in the profile of a single square or single rectangle and, said closed end of said bag having separate portions for receiving a thumb and at least two fingers of the user when said bag is fit over the hand of a user, applying the bag over the hand, wrist and portion of the user's arm, grasping an object with at least said thumb and two fingers of the user and everting said bag so that said bag encloses said object.

7. The method of claim 6 wherein said bag is sealed upon being everted entrapping said object therein.

8. A bag sized to fit over a hand, wrist and at least a portion of an arm of a user, said bag consisting essentially of an open end and a closed end and parallel side walls extending from said open end toward said closed end such that the portion of the bag sized to fit over a portion of the user's arm, and wrist is in the profile of a single square or a single rectangle and, at said closed end, said bag being configured to accept a thumb and at least two fingers of the user.

* * * * *